US008250975B2

(12) United States Patent
Cronin et al.

(10) Patent No.: US 8,250,975 B2
(45) Date of Patent: Aug. 28, 2012

(54) CONTAINER WITH COMPACTOR

(75) Inventors: Edward P. Cronin, Brodhead, WI (US); Joseph P. Valley, III, Roscoe, IL (US)

(73) Assignee: J.L. Clark, Inc., Rockford, IL (US)

( * ) Notice: Subject to any disclaimer, the term of this patent is extended or adjusted under 35 U.S.C. 154(b) by 168 days.

(21) Appl. No.: 12/607,412

(22) Filed: Oct. 28, 2009

(65) Prior Publication Data

US 2010/0101186 A1 Apr. 29, 2010

Related U.S. Application Data

(60) Provisional application No. 61/109,001, filed on Oct. 28, 2008.

(51) Int. Cl.
*B30B 7/00* (2006.01)
*A24F 23/00* (2006.01)
*B65D 25/06* (2006.01)

(52) U.S. Cl. ..... 100/233; 131/329; 131/112; 206/37; 206/236; 220/531

(58) Field of Classification Search ..... 100/35, 100/229 A, 233, 240, 245, 250, 251; 206/37, 206/236; 220/531; 131/329, 112; 53/436, 53/527
See application file for complete search history.

(56) References Cited

U.S. PATENT DOCUMENTS

| | | | | |
|---|---|---|---|---|
| 2,092,219 | A * | 9/1937 | Knox | 206/236 |
| 3,318,231 | A * | 5/1967 | Felts | 100/52 |
| 3,625,140 | A * | 12/1971 | Glanz | 100/100 |
| 3,680,478 | A * | 8/1972 | Beachner et al. | 100/229 A |
| 3,881,407 | A * | 5/1975 | Goar | 100/35 |
| 6,851,357 | B1 * | 2/2005 | Martorella et al. | 100/226 |

FOREIGN PATENT DOCUMENTS

WF WO 2008/066450 6/2008

* cited by examiner

*Primary Examiner* — Jimmy T Nguyen
(74) *Attorney, Agent, or Firm* — Reinhart Boerner Van Deuren P.C.

(57) ABSTRACT

A container is provided. The container includes a lid, a bottom and a compactor. The compactor is contained within the container and serves to collect, accumulate or compact any loose products within the container. The compactor and lid can mate such that rotation of the lid can transfer torque to the compactor to adjust a storage portion of the cavity of the container to collect, accumulate or compact the loose product.

10 Claims, 15 Drawing Sheets

CONTAINER WITH COMPACTOR

CROSS-REFERENCE TO RELATED PATENT APPLICATIONS

This patent application claims the benefit of U.S. Provisional Patent Application No. 61/109,001, filed Oct. 28, 2008, the disclosure and teachings of which are incorporated herein, in their entireties, by reference thereto.

FIELD OF THE INVENTION

This invention generally relates to containers and more particularly to containers for holding large numbers of small products such as smokeless tobacco or small candy pieces.

BACKGROUND OF THE INVENTION

Containers for storing products are generally well known in the art. One particular example where containers are used to store products is the use of a container to store smokeless tobacco. Loose tobacco and related tobacco products are typically packaged and sold in disc-shaped containers. In many cases, the containers comprise a metal lid seated upon either a metal, plastic or cardboard can.

Typically, the user will pinch the product between the thumb and a forefinger to accumulate product and remove it from the can. Unfortunately, as the product is used, the product settles to the bottom of the can making it more difficult to pinch and remove from the can. The settling effect of product within a container is not unique to smokeless tobacco. This may also occur with small product such as for example, small candy pieces including mints, small chocolates, hard coated chocolates or gums.

The present invention is directed towards improvements over the state of the art.

BRIEF SUMMARY OF THE INVENTION

The present invention has several aspects that may be claimed and stand as patentable independently and individually or in combination with other aspects, including but not limited to the following.

In one aspect, the invention provides a container comprising a lid, a container bottom and a compactor. The compactor is positioned within a cavity of the container bottom and adjusts a size of a storage portion of the cavity. The adjustment of the size of the storage portion reduces the volume in which stored product can be distributed to cause the product to collect, accumulate and/or compact.

In one particular embodiment, the lid engages the compactor such that the user can adjust the relative position of the lid and the container bottom to adjust the position of the compactor. In additional embodiments, the compactor and container bottom may have cooperating indexing structure to maintain the position of the compactor after it has been adjusted by the user. However, the indexing structure is only sufficiently secure that the user can then again adjust the position of the compactor when desired.

In another embodiment of the present invention a container is provided that includes a compactor arrangement within the cavity defining a storage portion of the cavity, the compactor arrangement at least partially selectively movable relative to the container bottom to adjust the size of the storage portion of the cavity.

In another implementation of the invention, a method of compacting loose products contained within a container is provided. The method comprising the step of selectively adjusting a storage portion of a cavity of the container to reduce the size of the cavity in which the loose product is stored.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
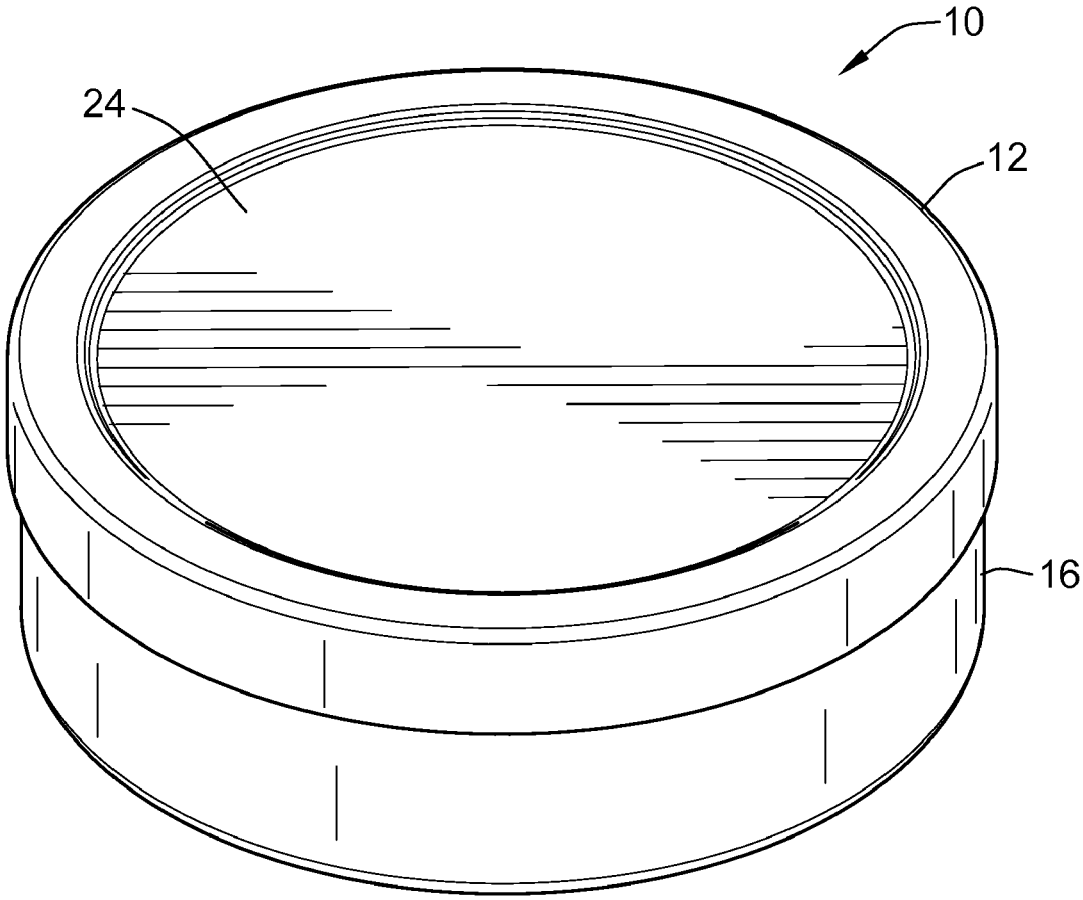
FIG. 1 is a top and front isometric view of an exemplary embodiment of a container in accordance with the teachings of the present invention.

FIG. 1 illustrates an embodiment of a container 10 according to the teachings of the present invention. The container 10 is preferably used for a product that desirably requires packing or accumulation of the product prior to removal from the container, such as for example smokeless tobacco. However, the invention is not limited to those applications. Embodiments of the inventive container may be used for other products such as for small candies including mints or hard coated chocolates or gum pieces for example, such that accumulating or packing the product facilitates easier removal from the container.

Figure 2:
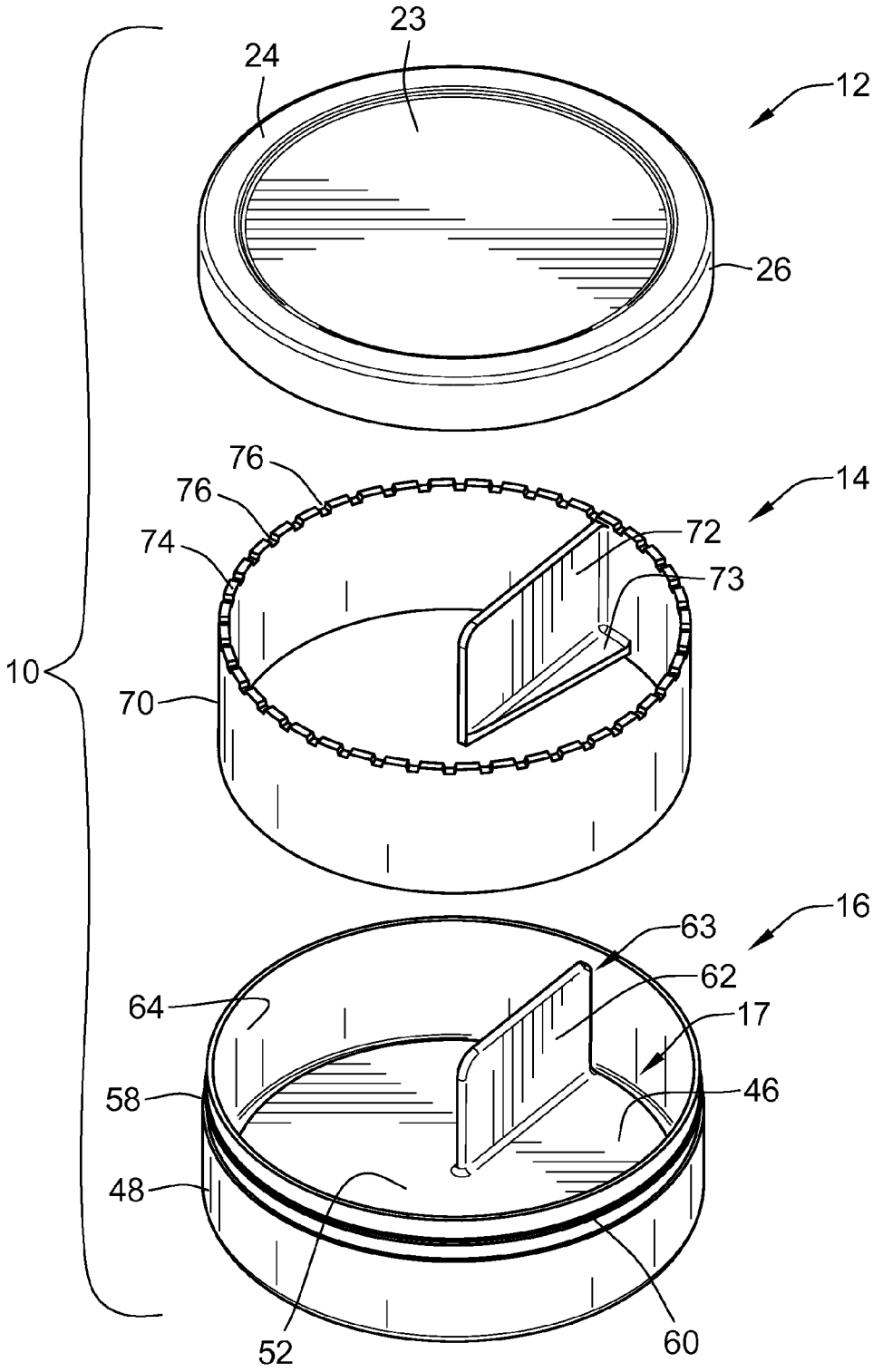
FIG. 2 is an exploded isometric view of the container of FIG. 1.
Figure 3:
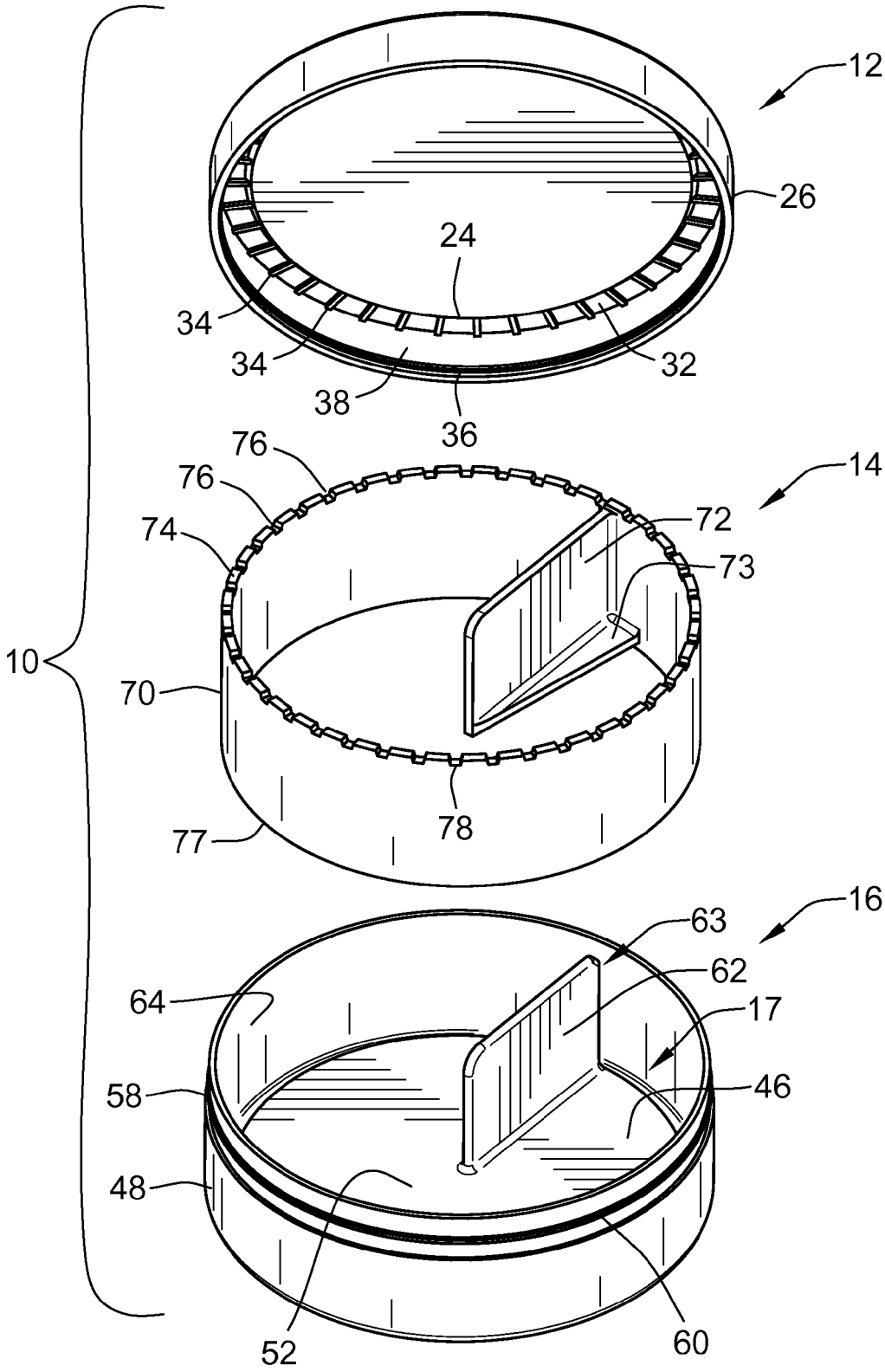
FIG. 3 is an exploded isometric view of the container of FIG. 1 showing the lid in a bottom front isometric view.

With further reference to FIGS. 2 and 3, the container 10 generally includes a lid 12, a compactor 14 and a container bottom 16 (also referred to as bottom 16). The lid 12 and container bottom 16 combine to define the outer periphery of the container 10.

Prior to sale, the container 10 may be held together by aesthetically pleasing band type labels which may contain a company's logo or name, or other designs (not shown), which may also provide for sealing the container during storage to maximize the shelf-life of the product stored within the container 10. Upon removal of or tearing of the label, a consumer is able to remove and reattach the lid 12 as many times as desired so as to be able to access the products stored in the container 10.

Figure 4:
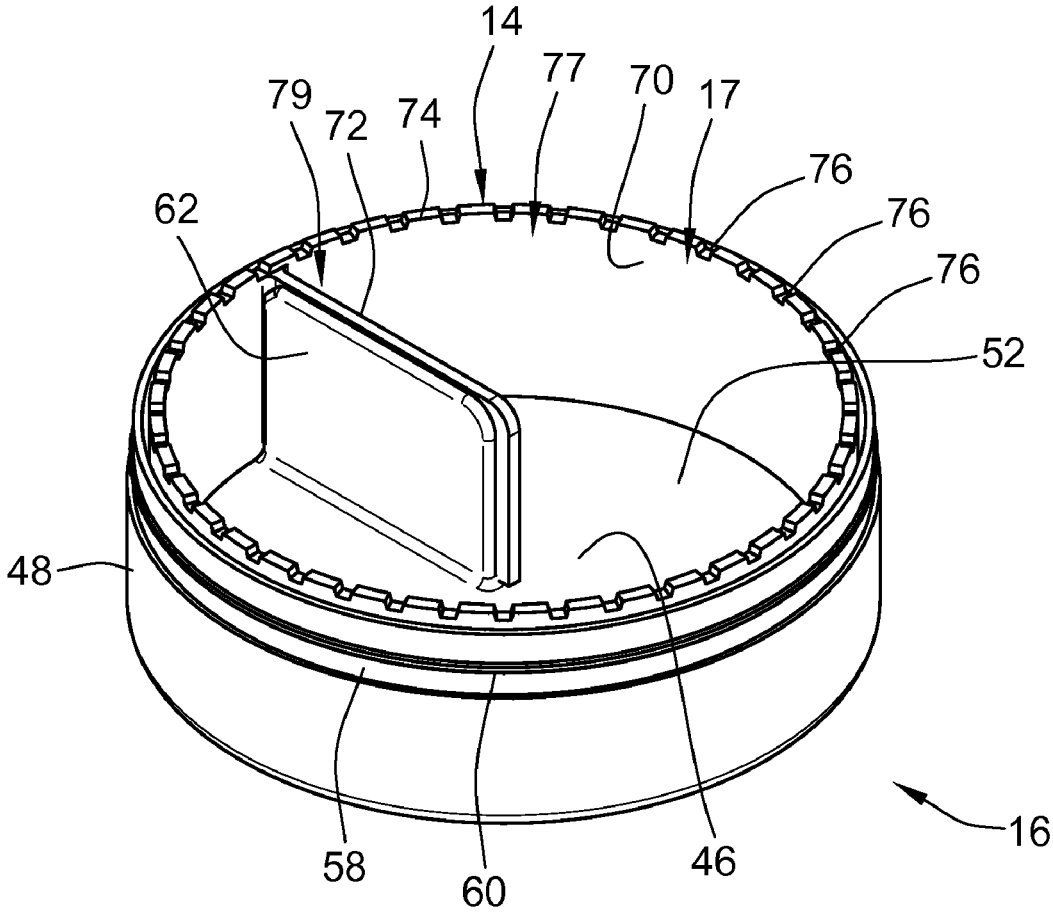
FIG. 4 is an isometric view of the container of FIG. 1 with the lid removed.

As illustrated in FIG. 4, the compactor 14 is generally located within a cavity 17 defined, at least in part, by bottom 16. The cavity is defined by upstanding sidewall 48 and bottom wall 46. The components of the container 10 are generally made of a hard plastic material or the like, but in other embodiments could be made from other materials such as a metal or cardboard. Typically, the plastic components will be molded.

Figure 23:
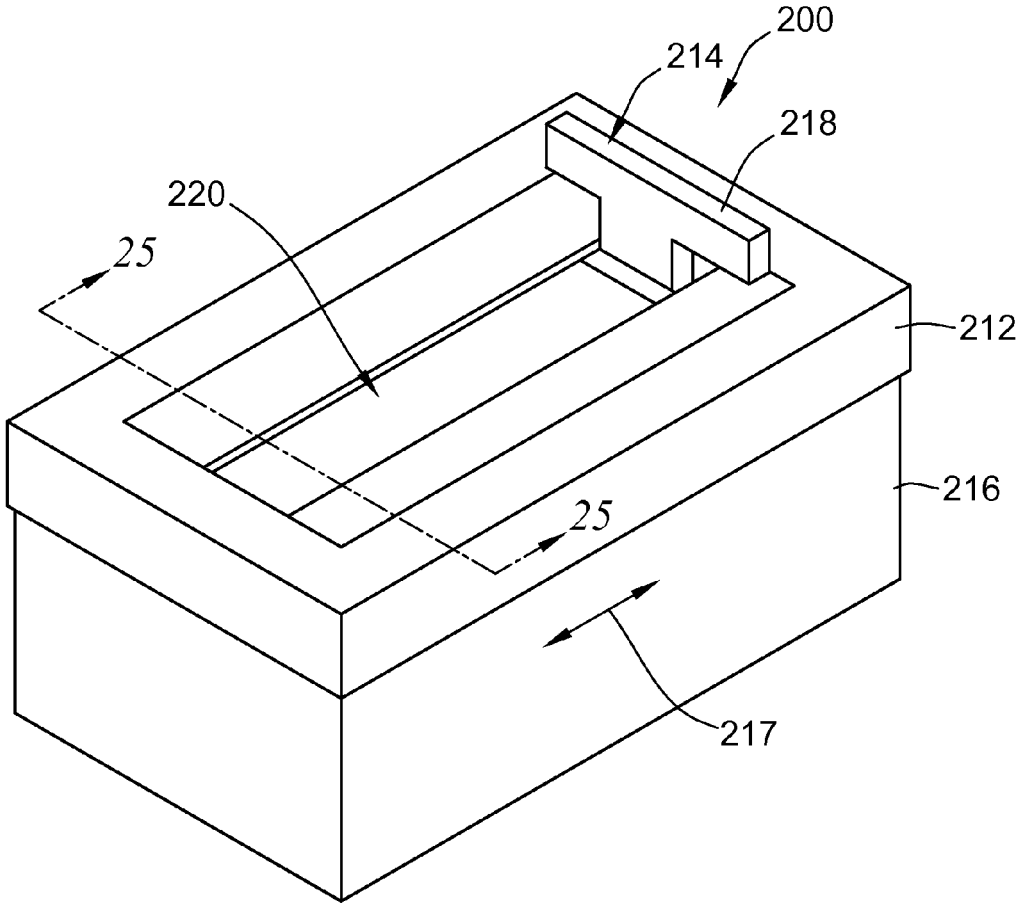
FIG. 23 is an alternative embodiment of a container according to the present invention having a generally rectangular shape.

With reference to FIG. 2, the lid 12 is generally cylindrical in shape and comprises a circular top wall 24 with a cylindrical skirt 26 formed integrally with and depending from the top wall 24. However, as illustrated in FIG. 23 other embodiments of the invention may have take other shapes such as generally rectangular shaped top and a skirt consisting of a skirt that has four sidewall portions integrally formed with and depending from the rectangular shaped top.

The top wall 24 of the illustrated embodiment includes a circular recessed inner portion 23 typically for locating advertising labels; other embodiments of the invention may not necessarily include the recessed inner portion. The outer surfaces of the top wall 24 or cylindrical skirt may be sufficiently textured such as by including stippling, ribs, grooves, dimples, projections, etc. to facilitate easy gripping of the lid 12.

Figure 5:
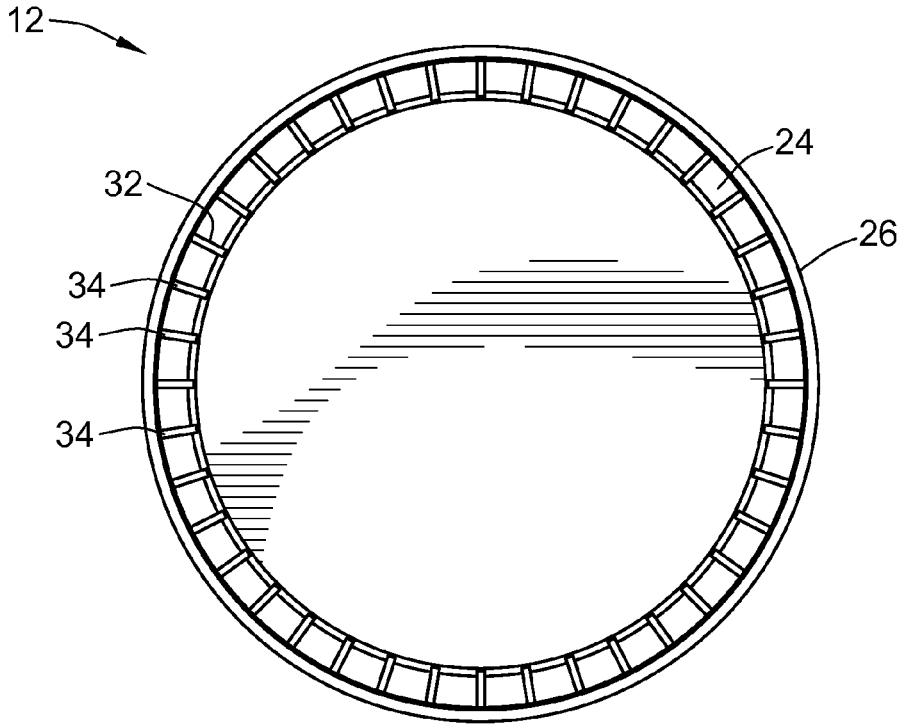
FIG. 5 is a bottom plan view of the lid of the container of FIG. 1.

Referring to FIGS. 3 and 5, the inner surface 32 of the top wall 24 includes a plurality of angularly spaced projections or nibs 34 that engage cooperating structure of the compactor 14 to facilitate movement of the compactor 14 within the bottom 16 by turning of the lid 12. However, other embodiments may not necessarily have these projections and can incorporate other means for engaging the compactor 14. For instance, the inner surface 32 could be smooth and container 10 could rely on mere friction between the compactor 14 and the lid 12 to allow for rotating compactor 14.

The skirt 26 of the lid 12 projects downwardly from the top wall 24 and has a diameter large enough to receive a top end of the sidewall 48 of the bottom 16. The skirt 26 includes an inwardly extending bead 36, which engages cooperating structure of the bottom 16 to releasably secure the lid 12 in place. The bead 36 is continuous around the entire inner surface 38 of the skirt 26, however in other embodiments this may not necessarily be the case and could be formed from a plurality of nibs or bead segments. Alternatively, a groove could be provided that receives a bead formed on the container bottom 16.

The bottom 16 of the container comprises a circular bottom wall 46 with a cylindrical sidewall 48 formed integrally with and extending from the bottom wall 46 forming cavity 17. As illustrated in FIG. 4, the compactor 14 is generally located within the cavity 17. When the lid 12 is attached to the bottom 16, the lid 12 and bottom 16 fully enclose cavity 17.

In other embodiments of the invention, the bottom wall may take on other shapes, such as the rectangular shape illustrated in the embodiment of FIG. 23. In that embodiment, the bottom 216 includes a series of four sidewall segments that generally bound a cavity.

Figure 7:
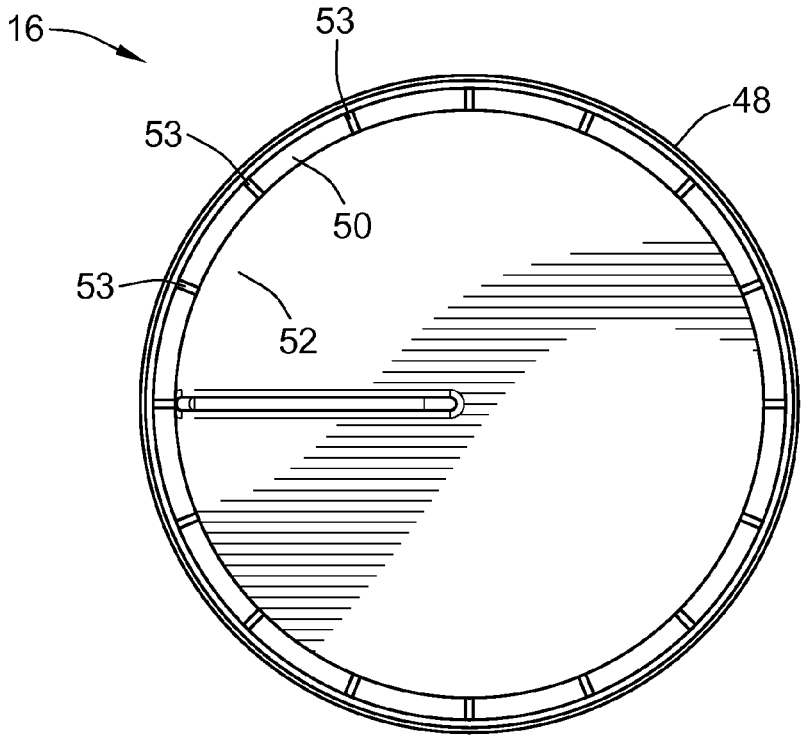
FIG. 7 is a top plan view of the bottom of a container with the lid removed shown with grooves for engaging and indexing a compactor.
Figure 6:
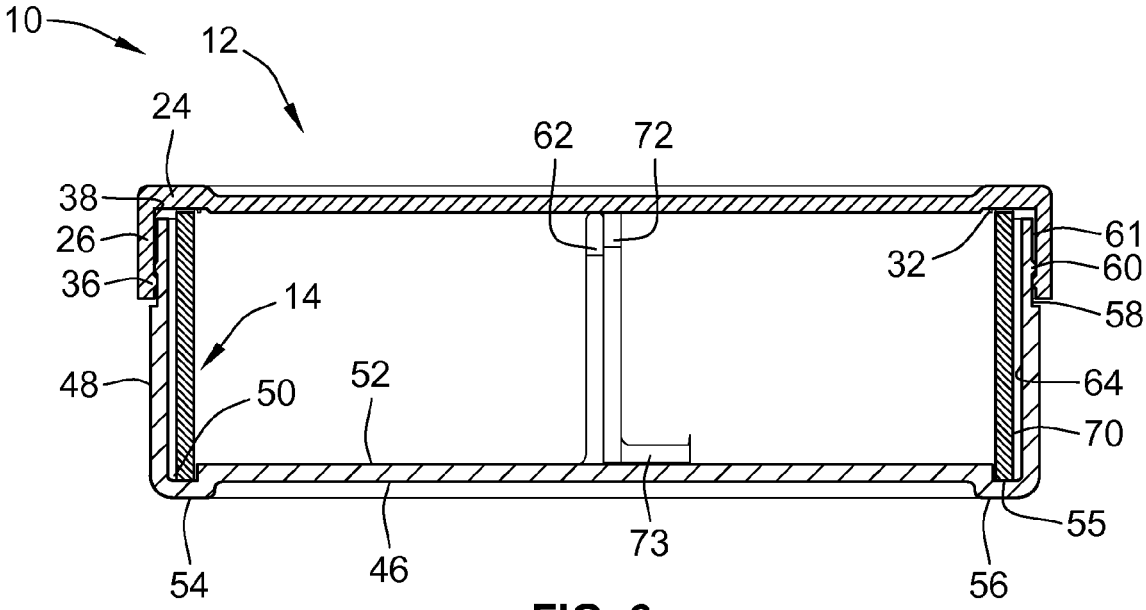
FIG. 6 is a front cross sectional view of the container of FIG. 1.

As illustrated in FIG. 6, the bottom wall 46 includes an annular axial recess 50 in the inner surface 52 proximate the juncture of the sidewall 48 and bottom wall 46. This recess 50 forms an annular channel in which an end 55 of a sidewall 70 of the compactor 14 is located. In embodiments of the invention, the recessed portion 50 may also have an engagement feature in the form of projections or serrations 53 as illustrated in FIG. 7. These serrations or projections 53 can interact with corresponding cooperating engagement structure formed in the distal end 55 of the sidewall 70 of the compactor 14 to maintain the angular position of the compactor 14 relative to the bottom 16.

Returning to FIG. 6, the cylindrical sidewall 48 has a neck portion 58 on the upper end of sidewall 48 opposite bottom wall 46. The neck portion 58 is a radially inward stepped portion of the outer surface of sidewall 48 and serves to accommodate the skirt 26 of lid 12 and has an outer diameter small enough to fit within the lid 12. The recessed configuration of neck portion 58 also serves to cause the outer surface of skirt 26 to be more flush with the outer surface of sidewall 48 of the bottom 16.

The recessed neck portion 58 further contains an outwardly extending bead 60 extending from an outer surface 61. The bead 60 interacts with corresponding bead 36 of lid 12. The bead 60 continues uninterrupted around the entire outer surface 61 of the neck portion 58. However in other embodiments of the illustrated invention, this may not be the case and bead 60 may be formed by a plurality of projections. The interaction of bead 60 and bead 36 allows the lid 12 to be releasably connected to the bottom 16.

In this embodiment, the inner surface 64 of the sidewall 48 is smooth to facilitate easy turning of the compactor 14 placed within it.

Figure 8:
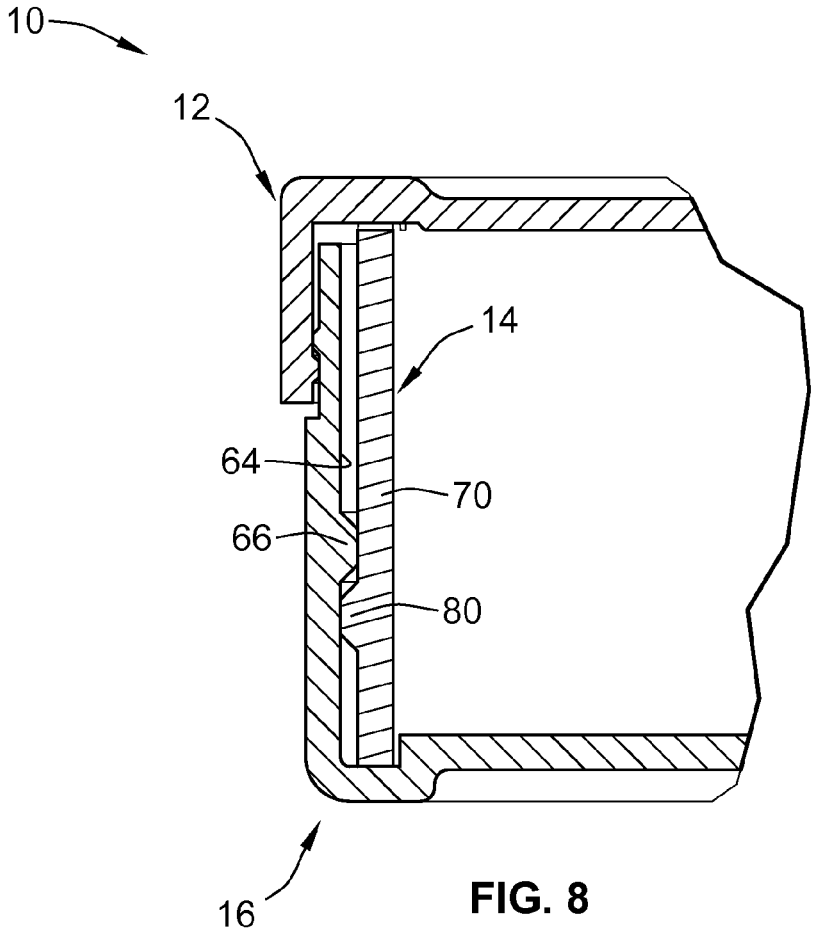
FIG. 8 is an enlarged partial illustration of a container having axially engaging ribs on the compactor and bottom to prevent axial removal of the compactor from the bottom.
Figure 9:
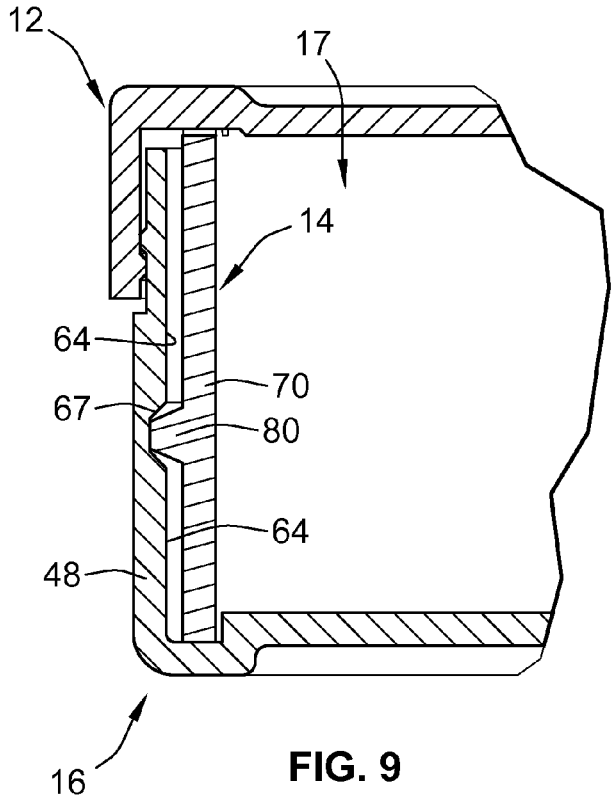
FIG. 9 is an enlarged partial illustration of an alternative embodiment of a container having an axially engaging arrangement to prevent axial removal of the compactor from the bottom similar to that of FIG. 8.

In preferred embodiments, illustrated in FIGS. 8 and 9, the inner surface 64 of sidewall 48 may include an inwardly extending bead 66 (FIG. 8) or a groove 67 (FIG. 9) to engage a corresponding feature of the compactor 14. The corresponding feature of the compactor 14 may be a bead 80 (as illustrated) or a corresponding groove. Further, the beads and grooves need not extend the entire circumference of the compactor 14 or bottom 16, but could be intermittent. This engagement axially secures the compactor 14 within cavity 17 of the bottom 16. This engagement can be particularly beneficial when transporting the combination of the container bottom 16 and compactor 14 when no lid is secured thereto.

In this embodiment, the bottom wall 46 of the bottom 16 includes an upwardly projecting integrally formed compactor wall 62 (see FIG. 2). The compactor wall 62 is formed in the container bottom 16 such that the structures are single one-piece construction. As used herein, single one-piece construction does not include components that are formed separately and then attached together such as by bolts or welding. Instead, a single one-piece construction is typically formed by molding the components together in a single process.

The compactor wall 62 is generally rectangular in shape and extends from inner surface 52 of the bottom wall 46. The compactor wall 62 preferably has a height similar to the height of sidewall 48. Further, the compactor wall 62 extends radially from a central location of the container bottom 16. In a preferred embodiment, the compactor wall 62 does not radially contact the central location or center point so as to facilitate rotation of the compactor 14. Further, the compactor wall 62 and sidewall 48 preferably form a gap 63 radially therebetween to accommodate the cylindrical wall 70 of the compactor 14. This gap 63 permits the compactor 14 to be axially inserted into container bottom 16 without axial interference between the sidewall 70 and compactor wall 62.

The compactor 14 of the container 10 comprises a cylindrical wall 70 and a compactor blade 72. The wall 70 has an outer diameter small enough to provide a clearance to allow it to rest within the sidewall 48 of the bottom 16 and the skirt 26 of the lid 12. The wall 70 also has a thickness that is small enough that will allow it to rest within the recessed outer portion of the inner surface 52 of the bottom 16, and still allow angular movement within the bottom 16.

With reference to FIG. 3, there are a series of grooves 76 formed into the top end 74 of the compactor wall 70, which match up with the nibs 34 of the lid 12. The grooves 76 and nibs 34 engage to provide an engagement between the compactor and the lid 12. This allows the user to rotate the compactor 14 relative to container bottom 16 by rotating lid 12 relative container bottom 16. However, other cooperating engagement structure may be provided between the lid 12 and the compactor 14 to transfer torque therebetween. For example, mere friction between an inner surface of lid 12 and end 74 may provide sufficient torque transfer therebetween.

With the lid removed, the compactor 14 in this embodiment floats axially in the bottom 16 of the container 10. However, as indicated previously, in other embodiments, the compactor 14 may contain an outwardly extending bead 80 to axially maintain the compactor 14 within container bottom 16. With reference to FIG. 8, the bead 80 would connect with the bead 66 of the bottom 16 to hold the compactor in place within the bottom 16. In yet another embodiment of the present invention (see FIG. 9), the bead 80 would connect with a groove 67 in the inner surface 64 of the sidewall 48 of the bottom 16, which would serve the same purpose of holding the compactor 14 in the bottom 16. Alternatively, bead 80 may be replaced by a groove that interacts with a corresponding bead of the container bottom 48.

Returning again to FIG. 2, the compactor blade 72 of the compactor 14 is generally rectangular in shape and projects substantially perpendicularly from a given tangent of the cylindrical wall 70 (i.e. radially inward). The compactor blade 72 includes a scraping flange 73 that is generally triangular in shape and attached to and outwardly (i.e. angularly) extending from the bottom of the compactor blade 72 and radially inward from sidewall 70. In other embodiments a scraping flange 73 need not be present. As the compactor 14 rotates relative to the container bottom, the compactor blade 72 with attached scraping flange 73 acts as a scoop or scraper to lift product off of the bottom surface 52 of the container bottom 16. Additionally, as the compactor 14 rotates relative to the container bottom 16, the compactor blade 72 and compactor wall 62 accumulate and compact any loose products inside the container 10.

Figure 10:
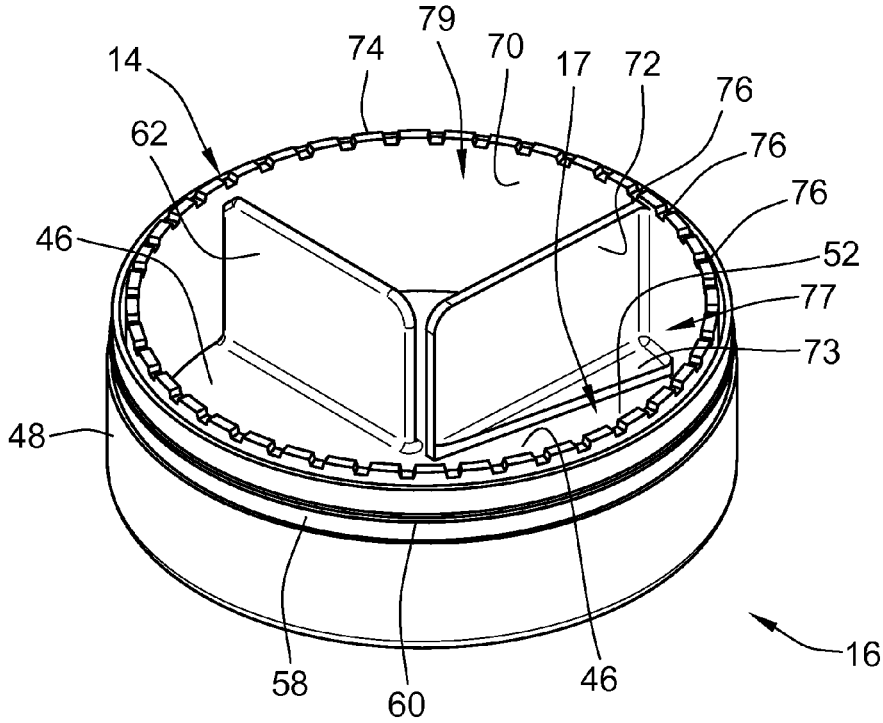
FIG. 10 is an isometric view of the container of FIG. 4 with the compactor shown in a rotated (i.e. indexed) position.
Figure 11:
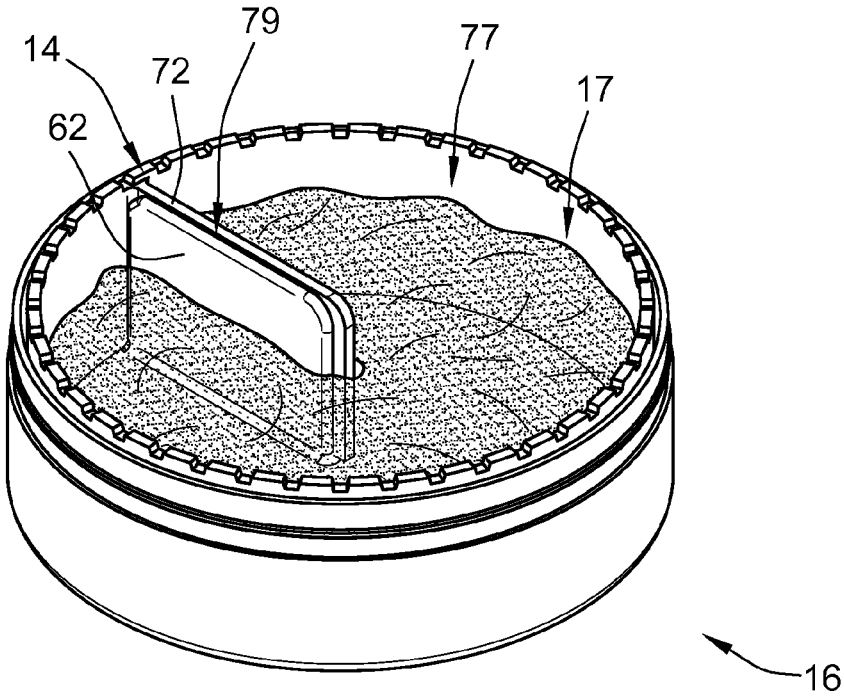
FIG. 11 is an isometric view of the container of FIG. 4 with the container filled with a product such as smokeless tobacco.
Figure 12:
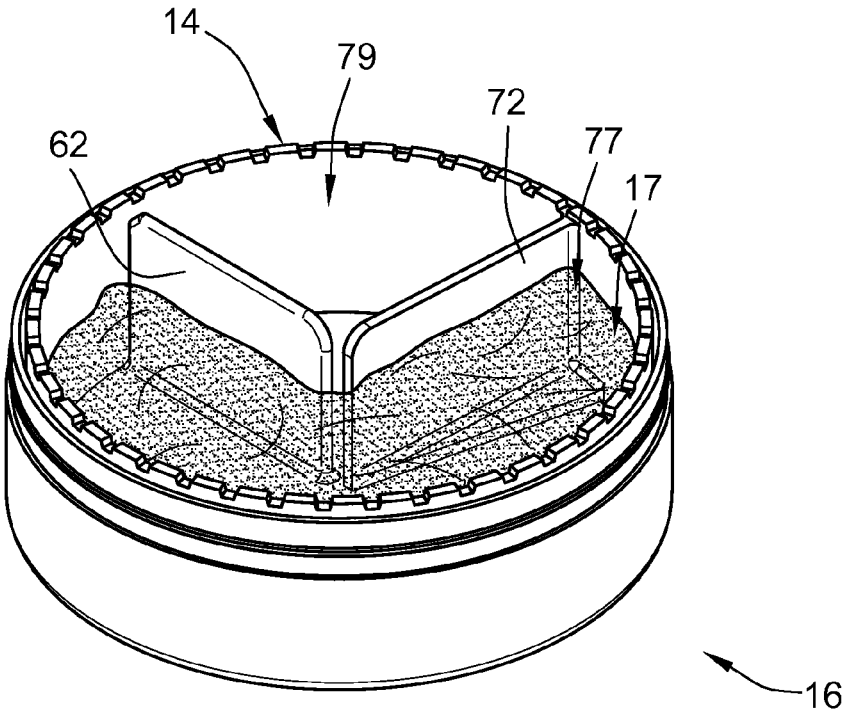
FIG. 12 is an isometric view of the container as oriented in FIG. 10 with the container filled with a product such as smokeless tobacco.

The ability to rotate the compactor 14 relative to bottom 16 is illustrated in FIGS. 4 and 10 (without product) as well as FIGS. 11-14. This ability to rotate relative to bottom 16 permits the compactor 14 to compact products within cavity 17 of bottom 16.

With reference to FIGS. 11-14, the compactor 14, and particularly compactor blade 72, separates cavity 17 into a storage portion 77 and an empty portion 79. The storage portion 77 is the portion defined between the compactor blade 72 and compactor wall 62 in a first angular direction (i.e. the portion in which the product is housed). The empty portion 79 is the portion defined between the compactor blade 72 and compactor wall 62 in a second angular direction (i.e. the portion that is void of product) As the compactor 14 rotates relative to bottom 16, the compactor blade 72 adjusts the volume of the storage portion 77 and empty portion 79. By reducing the volume of the storage portion 77, product stored therein is gathered such that it compacts such that it becomes deeper to facilitate easier removal from the container 10. This also facilitates packing for products such as for smokeless tobacco.

As illustrated in the progression from FIGS. 11-14, product is gathered by the compactor blade 72 attached to the compactor 14, and pushed angularly toward compactor wall 62 of the bottom 16 via the turning motion of the compactor 14 until a desired compression and depth of the product is achieved. When the product becomes sufficiently low, the user can rotate compactor 14 relative to bottom 16 to reduce the useable volume of cavity 17 and cause the product to compact and become deeper (see transition from FIG. 11 to FIG. 12). Particularly, compactor blade 72 is angularly rotated toward compactor 62 to reduce the volume of the storage portion 77.

Figure 13:
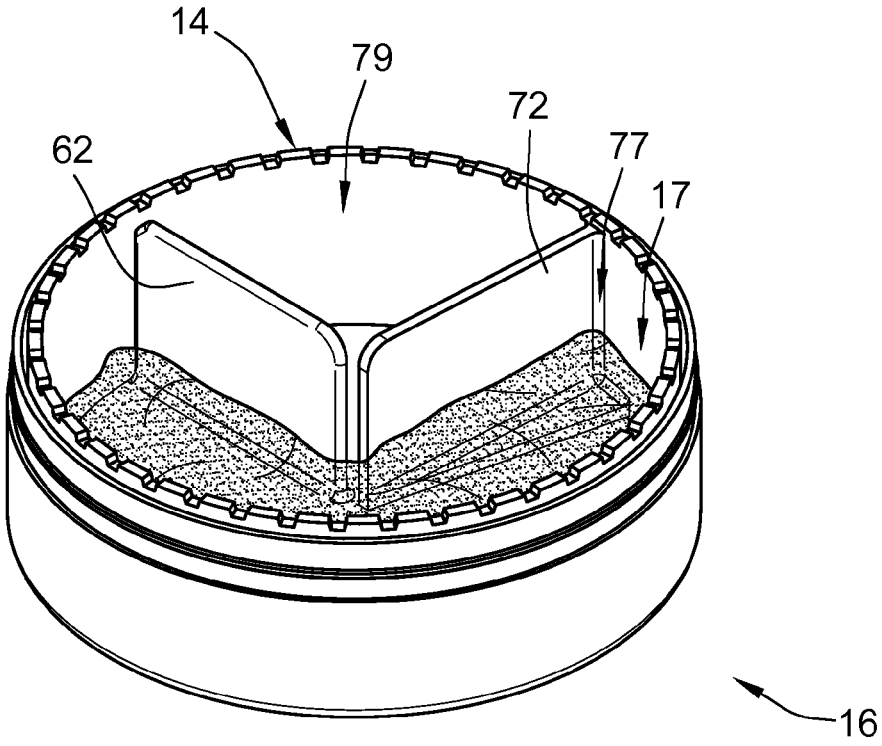
FIG. 13 is an isometric view of the container as oriented in FIG. 12 after some of the product has been removed.
Figure 14:
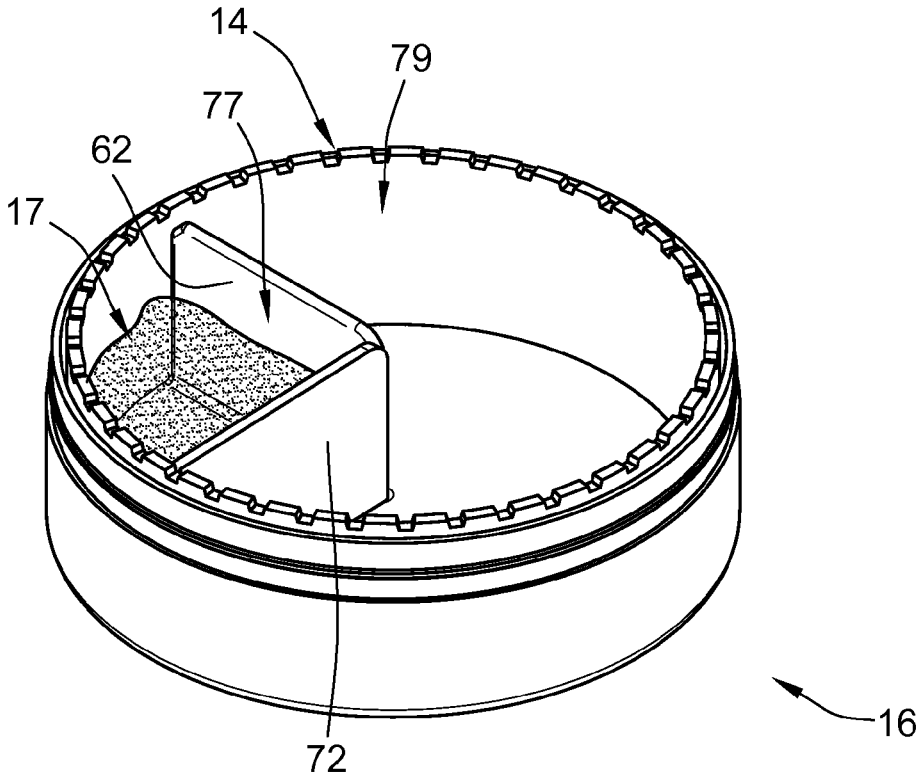
FIG. 14 is an isometric view of the container of FIG. 13 after the products have been re-compacted by indexing the compactor.

Once the product becomes too shallow or sufficiently unpacked in this new orientation of the compactor blade 72 relative to compactor wall 62 (see FIG. 13), the user can once again re-orient the compactor blade 72 relative to compactor wall 62 to once again reduce the usable volume of storage portion 77 and re-pack and re-gather the product therein to once again increase the depth of the product and facilitate easier removal from container 10 (see transition from FIG. 13 to FIG. 14). Again, typically, this adjustment of the storage volume is performed by rotating the lid 12, which engages compactor 14, as outlined previously. Further, it should then be apparent that in this embodiment that the incremental decrease in volume of the storage portion 77 creates an equal incremental increases in volume of the empty portion 79. Further, in some orientations, such as illustrated in FIG. 4, the empty portion 79 may have no volume as the compactor blade 72 may be abutted against the compactor wall 62. This is typically the case when the container is first filled with product.

Figure 15:
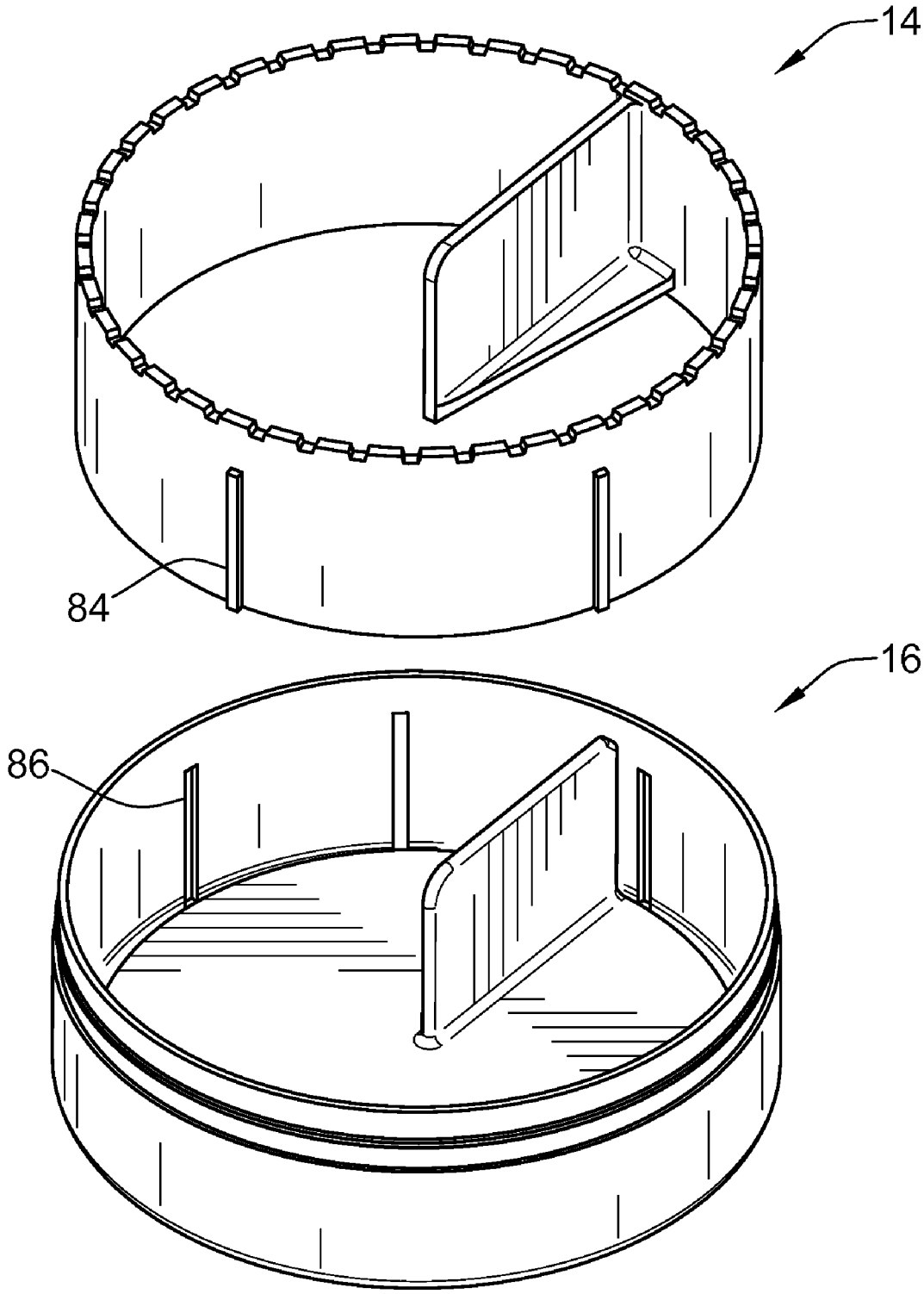
FIG. 15 is an exploded isometric view of the embodiment of a compactor and bottom having radial indexing structure.
Figure 16:
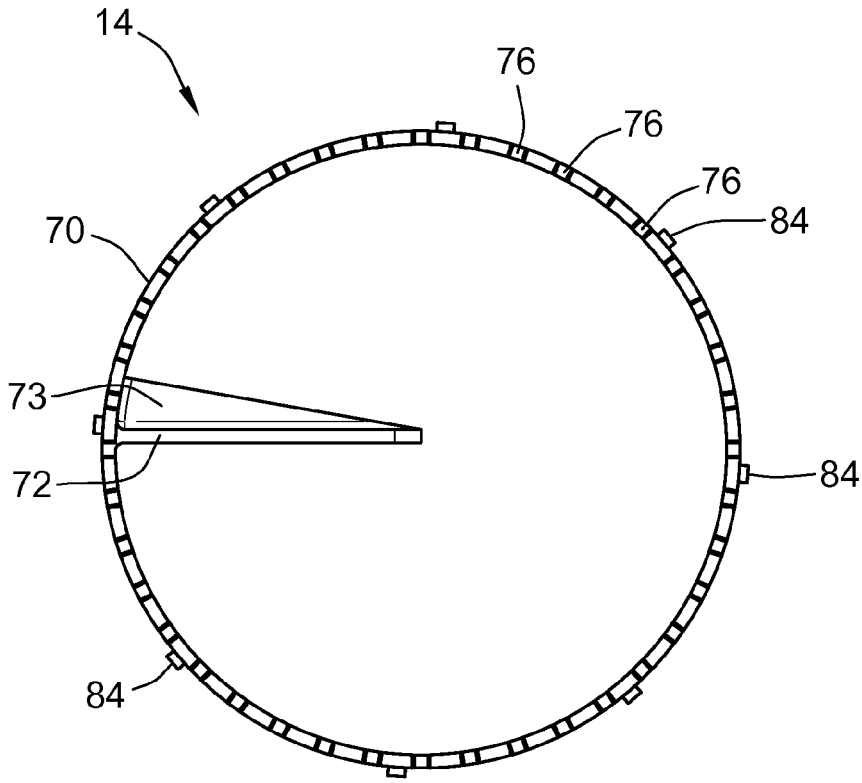
FIG. 16 is a top view of the compactor of FIG. 15.

With reference to FIGS. 15 and 16, in some embodiments of the invention, the compactor 14 may have indexing structure, illustrated in the form of angularly spaced projections 84, which alternatively may be serrations or grooves, that will interact with equivalently spaced grooves 86, which could alternatively be cooperating ribs or projections, on the inner surface 64 of the sidewall 48 of the bottom 16 as can be seen in FIG. 15. Typically, only a single feature is needed on one of the compactor 14 or container bottom 16, while the other one will include a plurality of features such that incremental indexing of the compactor 14 relative to the container bottom 16 can be easily effectuated.

This interaction of the indexing structure, i.e. ribs/serrations 84, 86 provides some engagement between the bottom 16 and compactor 14 to maintain the compactor 14 in a desired indexed location, and more particularly compactor blade 72. However, the engagement therebetween will be less than that of the lid 12 and the compactor 14, such that the user can still facilitate movement between the compactor 14 and bottom 16 when the lid 12 is turned. In this embodiment, the indexing structures radially engage one another.

Figure 17:
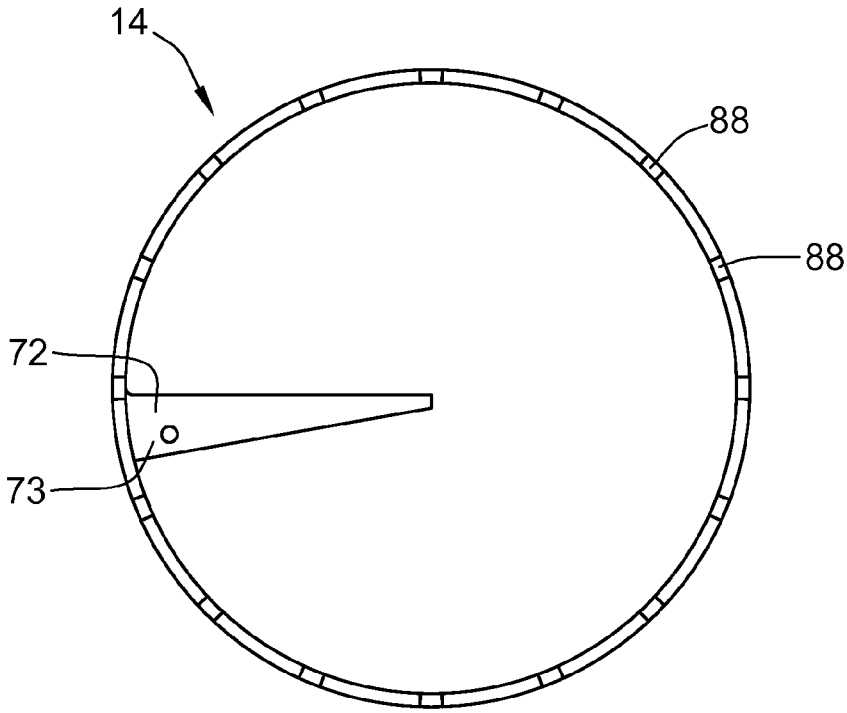
FIG. 17 is a bottom plan view of the compactor of the container of FIG. 1 illustrating projections or serrations on the bottom for facilitating indexing.
Figure 18:
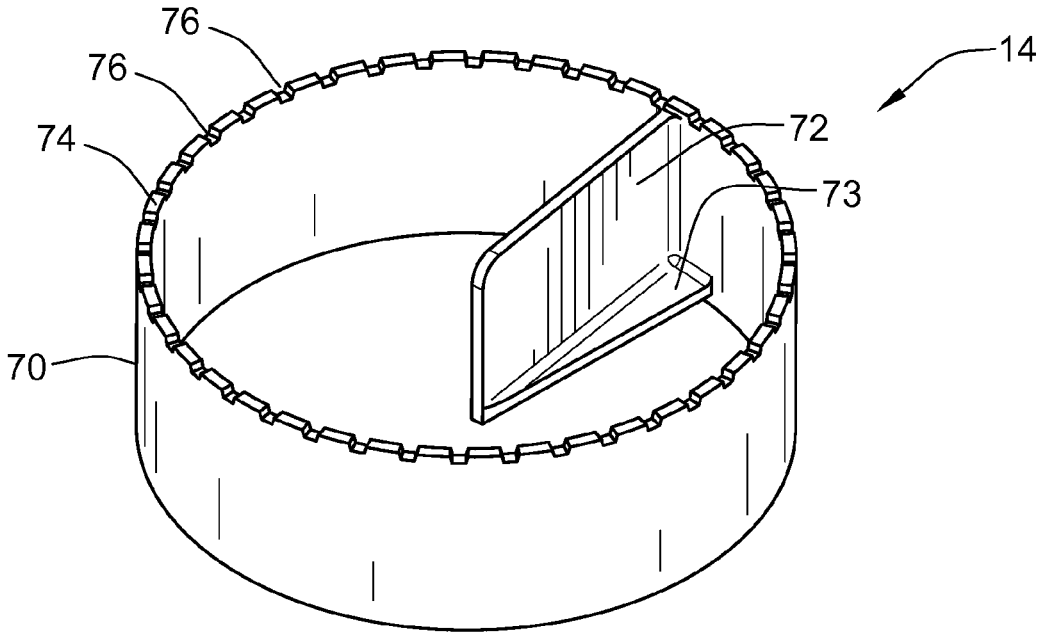
FIGS. 18-22 are alternative views of various components of embodiments of containers according to the teachings of the present invention.
Figure 19:
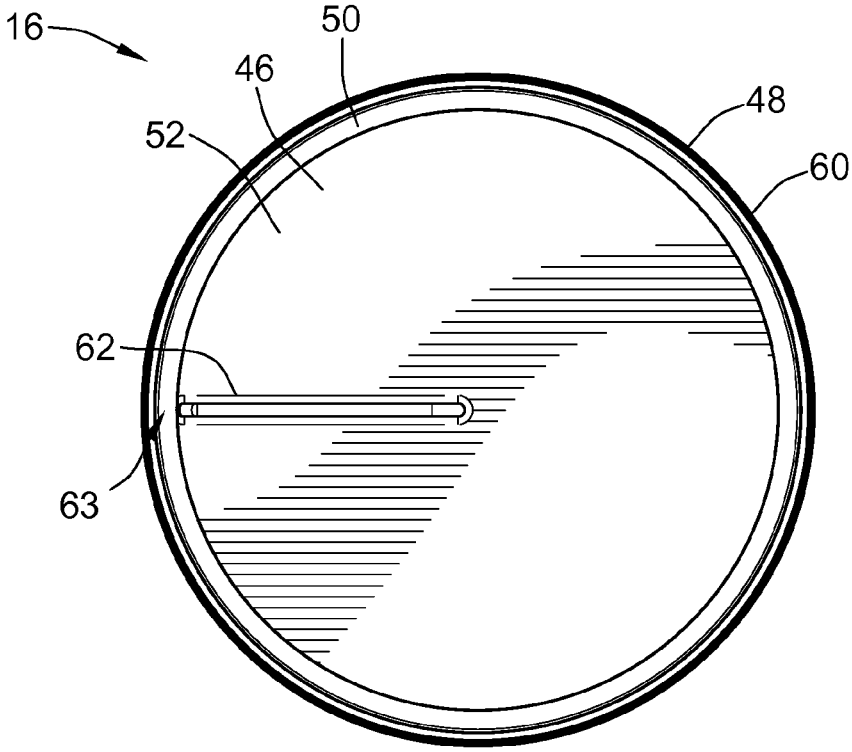
Figure 20:
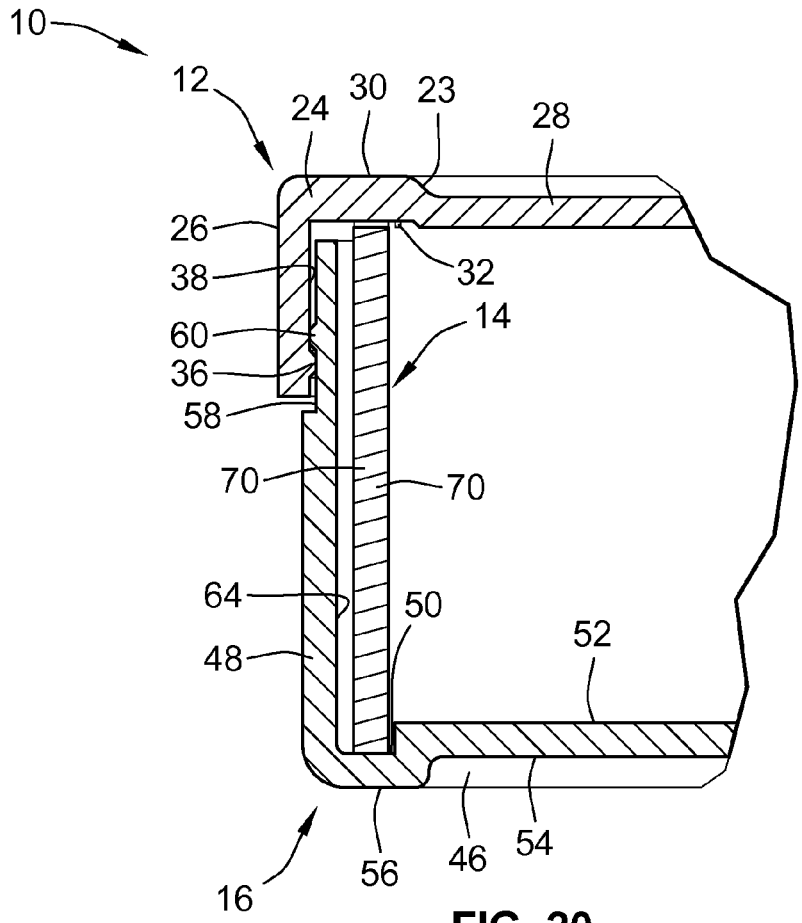
Figure 21:
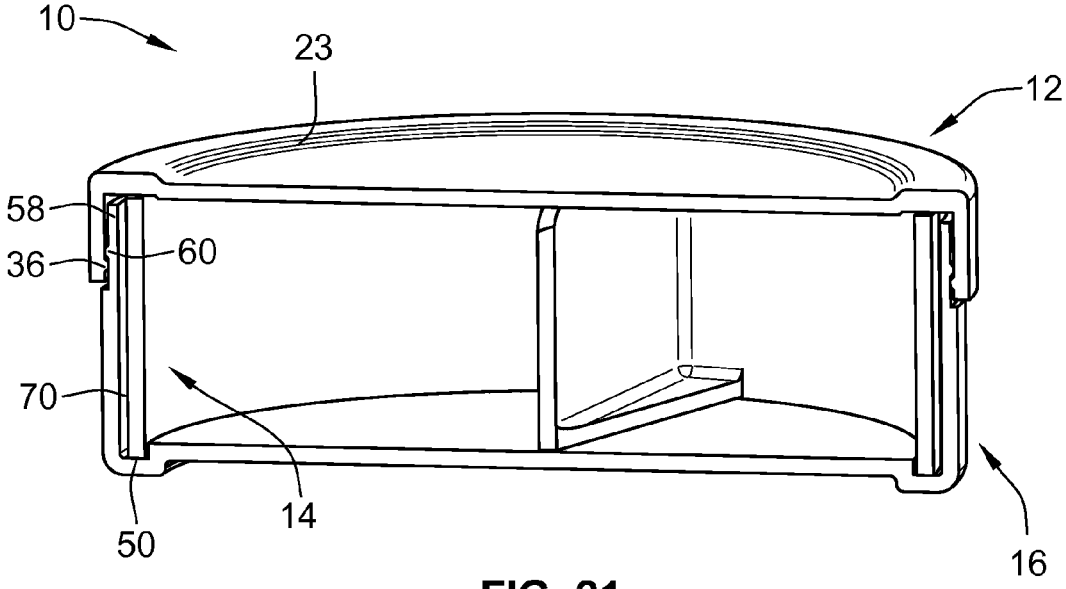
Figure 22:
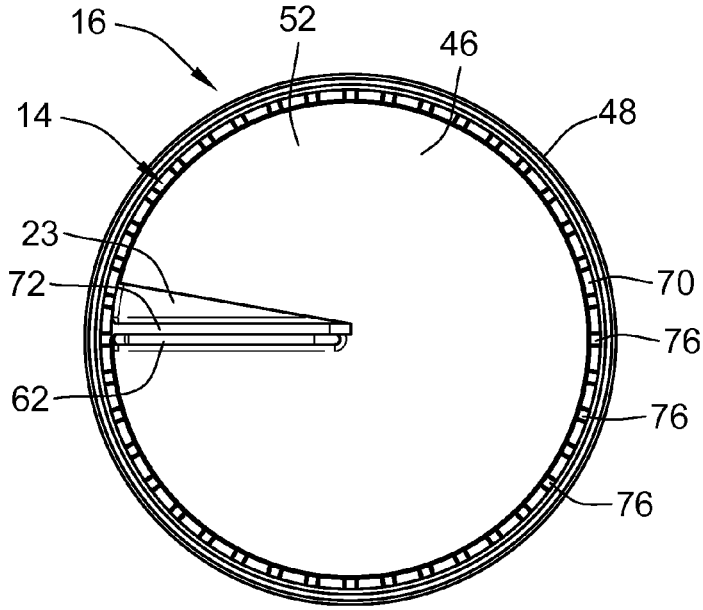

Similarly, in other embodiments as illustrated in FIGS. 7 and 17, the indexing structure could axially engage one another. For example, the bottom wall 46 could have grooves or projections 53 that axially engage corresponding projections and serrations 88 of an end of sidewall 70. This interaction would provide an engagement to prevent any unintentional movement of the compactor 14 relative to bottom 16, just as explained with the previous embodiment.

Alternatively, the indexing structure could be formed radially inward from sidewall 70 and could be formed by compactor blade 72 and interact with corresponding structure formed in bottom wall 46.

However, the arrangement illustrated in FIG. 15 is highly desirable as the cooperating indexing structure is hidden or protected from any product that is stored in container 10. Thus, no product would get into the indexing structure and interfere with the engagement therebetween. Any interference could prevent the indexing structure from maintaining the compactor 14 in the indexed angular position relative to bottom 16.

Figure 24:
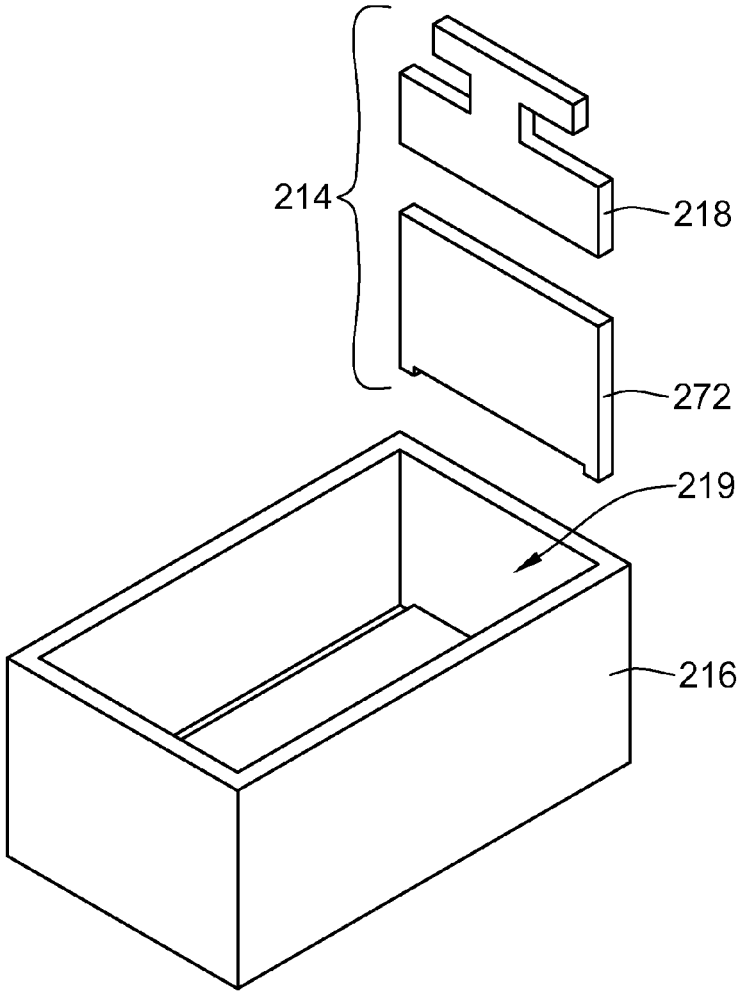
FIG. 24 is a partial exploded isometric view of the bottom and compactor sections of the container of FIG. 23.
Figure 25:
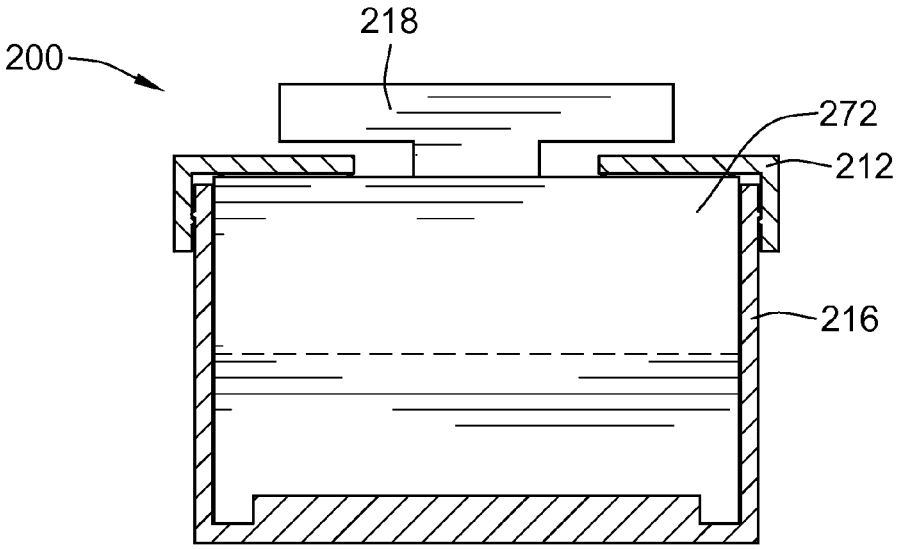
FIG. 25 is a side cross-sectional view of the container of FIG. 23.

A further embodiment of a container 200 according to the teachings of the present invention is illustrated in FIGS. 23-25. In this embodiment, the container 200 is rectangular in profile, rather than circular as in the previous embodiments. The container includes a lid 212 and a bottom 216 that combine to define a cavity for storing product.

The container includes a compactor 214 for adjusting the storage volume of the cavity defined by the bottom 216 of the container 200. The compactor 214 can be moved axially along the container bottom 216 to collect and pack product stored within the container bottom 216, much like compactor 14 of previous embodiments. However, rather than rotating about a central axis, this compactor 214 moves axially.

In this embodiment, a handle 218 of the compactor 214 extends axially through a slot 220 defined in the lid 212. The handle 218 can be grasped by the user to bias the compactor along or parallel to longitudinal axis 217 of the container 212.

The compactor 214 also includes a compactor blade 272 that actually separates cavity 219 of the container bottom 216 into a storage volume (i.e. the section that includes product) and an empty volume (the section that is void of any product), like compactor blade 72 of the previous embodiments.

The handle 218 is operably coupled to compactor blade 272 to facilitate positioning the compactor blade 272. In the illustrated embodiment, handle 218 and compactor blade 272 are separate components. However, in alternative embodiments, the two components may be integrally formed in a unitary one-piece body.

Further, the compactor 214 may include indexing structure like the prior embodiments to maintain the axial position of the compactor 214 relative to the container bottom 216 and container lid 212 when the container 200 is not being accessed by a user.

The two part configuration of the illustrated embodiment facilitates easier removal of the lid 212. However, alternative configurations of the handle 218 may be implemented to facilitate arrangements where the entire compactor 214 remains with the container bottom 216 when the lid 212 is removed therefrom.

This embodiment illustrates, that other structures may be used, other than the lid, to manipulate the position of the compactor relative to the container bottom of the container. Further, a compactor need not necessarily be able to be manipulated when the lid is attached to the container bottom. For example, a container may only include a container bottom such as container bottom 216 and a compactor blade 272 but have a solid lid. In such an arrangement, the user must push the compactor blade 272 by hand when the lid is removed from the container.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a container bottom;

a lid operably couplable to the container bottom, the lid and container bottom defining a cavity; and a compactor within the cavity defining a storage portion of the cavity, the compactor selectively movable relative to the container bottom to adjust the size of the storage portion of the cavity;

wherein the compactor further defines an empty portion of the cavity, the compactor separating the storage portion from the empty portion such that when the compactor increases the volume of one of the storage or empty portions, the compactor decreases the volume of the other one of the empty or storage portions;

a compactor wall extending upward from a bottom wall of the container bottom;

the compactor includes a compactor blade, the storage portion being defined, at least in part, between the compactor wall and the compactor blade, the compactor blade being movable relative to the container bottom such that the position of the compactor blade is adjustable relative to the compactor wall to adjust the storage portion therebetween;

wherein the container bottom is cup-shaped including an annular sidewall extending from the bottom wall, the bottom wall and annular sidewall defining the cavity, the compactor wall extending radially inward toward a central axis of the annular sidewall, the compactor blade movable angularly about the central axis generally relative to the compactor wall; and wherein a radial gap is formed between the annular sidewall and a radial end of the compactor wall, the compactor further including a cylindrical compactor wall from which the compactor blade extends radially inward, the cylindrical compactor wall received in the radial gap.

2. The container of claim 1, wherein the empty portion of the cavity is angularly formed between a first face of the compactor blade and a first face of the compactor wall which angularly face one another and the storage portion of the cavity is angularly formed between a second face of the compactor blade and a second face of the compactor wall which angularly face one another, the first and second faces of the compactor wall being on opposite angular sides of the compactor wall and the first and second faces of the compactor blade being on opposite angular sides of the compactor blade.

3. A container comprising:

a container bottom;

a lid operably couplable to the container bottom, the lid and container bottom defining a cavity; and a compactor within the cavity defining a storage portion of the cavity, the compactor selectively movable relative to the container bottom to adjust the size of the storage portion of the cavity;

wherein the compactor further defines an empty portion of the cavity, the compactor separating the storage portion from the empty portion such that when the compactor increases the volume of one of the storage or empty portions, the compactor decreases the volume of the other one of the empty or storage portions;

a compactor wall extending upward from a bottom wall of the container bottom;

the compactor includes a compactor blade, the storage portion being defined, at least in part, between the compactor wall and the compactor blade, the compactor blade being movable relative to the container bottom such that the position of the compactor blade is adjustable relative to the compactor wall to adjust the storage portion therebetween; and wherein the lid and compactor include cooperating engagement structure to angularly engage the lid with the compactor such that rotation of the lid causes rotation of the compactor blade to adjust the size of the storage portion.

4. The container of claim 3, wherein the compactor and container bottom include cooperating indexing structure that maintains the orientation of the compactor blade relative to the container bottom to maintain the sizes of the storage portion and empty portion.

5. The container of claim 3, wherein the container bottom is cup-shaped including an annular sidewall extending from the bottom wall, the bottom wall and annular sidewall defining the cavity, the compactor wall extending radially inward toward a central axis of the annular sidewall, the compactor blade movable angularly about the central axis generally relative to the compactor wall.

6. The container of claim 3, wherein:

the cooperating engagement structure includes at least one notch formed in one of a top end of the compactor and an inner surface of the top wall of the lid and at least one projection formed in the other one of the top end of the compactor and the inner surface of the top wall of the lid.

7. The container of claim 3, wherein the compactor blade further comprises a scooping device attached to and extending perpendicularly from the bottom of the compactor blade.

8. The container of claim 3, wherein the compactor and container bottom include cooperating axial retaining structure that axially engage to retain the compactor axially within the container bottom when the lid is removed.

9. The container of claim 3, further comprising loose product stored in the storage cavity.

10. A container comprising:

a container bottom;

a lid operably couplable to the container bottom, the lid and container bottom defining a cavity; and a compactor arrangement within the cavity defining a storage portion of the cavity, the compactor arrangement at least partially selectively movable relative to the container bottom to adjust the size of the storage portion of the cavity; wherein the compactor further defines an empty portion of the cavity, the compactor separating the storage portion from the empty portion such that when the compactor increases the volume of one of the storage or empty portions, the compactor decreases the volume of the other one of the empty or storage portions;

wherein the compactor and container bottom include cooperating indexing structure that maintains the orientation of the compactor relative to the container bottom to maintain the sizes of the storage portion and empty portion;

further comprising a compactor wall extending upward from a bottom wall of the container bottom;

the compactor includes a compactor blade, the storage portion being defined, at least in part, between the compactor wall and the compactor blade, the compactor being movable relative to the container bottom such that the position of the compactor blade is adjustable relative to the compactor wall to adjust the storage portion therebetween;

wherein the container bottom is cup-shaped including an annular sidewall extending from the bottom wall, the bottom wall and sidewall defining the cavity, the compactor wall extending radially inward toward a central axis of the annular sidewall, the compactor blade movable angularly about the central axis generally relative to the compactor wall;

wherein a radial gap is formed between the annular sidewall and a radial end of the compactor wall, the compactor further including a cylindrical compactor wall from which the compactor blade extends radially inward, the cylindrical compactor wall received in the radial gap;

wherein the empty portion of the cavity is angularly formed between a first face of the compactor blade and a first face of the compactor wall which angularly face one another and the storage portion of the cavity is angularly formed between a second face of the compactor blade and a second face of the compactor wall which angularly face one another, the first and second faces of the compactor wall being on opposite angular sides of the compactor wall and the first and second faces of the compactor blade being on opposite angular sides of the compactor blade;

wherein the lid and compactor include cooperating engagement structure to angularly engage the lid with the compactor such that rotation of the lid causes rotation of the compactor to adjust the size of the storage portion;

wherein the cooperating engagement structure includes at least one notch formed in one of a top end of the compactor and an inner surface of the top wall of the lid and at least one projection formed in the other one of the top end of the compactor and the inner surface of the top wall of the lid;

wherein the compactor blade further comprises a scooping device attached to and extending perpendicularly from the bottom of the compactor blade;

wherein the compactor wall is integrally formed with the container bottom as a single one piece construction; and wherein the compactor and container bottom include cooperating axial retaining structure that axially engage to retain the compactor axially within the container bottom when the lid is removed.

* * * * *